US005358793A

United States Patent [19]

Hanada et al.

[11] Patent Number: 5,358,793

[45] Date of Patent: Oct. 25, 1994

[54] PTC DEVICE

[75] Inventors: Toshiyuki Hanada, Kawaguchi; Mayumi Takata; Naoki Yamazaki, both of Tokyo; Isao Morooka; Kazuhiko Harazaki, both of Hachioji, all of Japan

[73] Assignee: Daito Communication Apparatus Co., Ltd., Tokyo, Japan

[21] Appl. No.: 879,566

[22] Filed: May 7, 1992

[30] Foreign Application Priority Data

May 7, 1991 [JP] Japan ..... 3-101465
Sep. 2, 1991 [JP] Japan ..... 3-221613

[51] Int. Cl.[5] ..... B22F 7/04

[52] U.S. Cl. ..... 428/560; 428/546; 428/548; 428/551; 428/552; 428/553; 428/554; 252/512; 252/514; 338/22 SD; 338/22 R; 264/104

[58] Field of Search ..... 174/92; 219/541, 548; 252/511, 512, 514; 338/314, 22 R, 22 SD; 361/58; 427/96; 428/349, 546, 548, 551, 552, 553, 554, 560; 524/495; 264/104

[56] References Cited

U.S. PATENT DOCUMENTS 4,189,509 2/1980 Hill ..... 427/102
4,314,230 2/1982 Cardinal et al. ..... 338/314
4,595,606 6/1986 St. John et al. ..... 427/96
4,849,133 7/1989 Yoshida et al. ..... 252/511
4,977,309 12/1990 Uchida ..... 219/541
5,039,844 8/1991 Nagahori ..... 219/541
5,171,774 12/1992 Ueno et al. ..... 524/495

FOREIGN PATENT DOCUMENTS 3220362 1/1983 Fed. Rep. of Germany .
2281707 11/1990 Japan .
3059985 3/1991 Japan .

*Primary Examiner*—Donald P. Walsh
*Assistant Examiner*—John N. Greaves
*Attorney, Agent, or Firm*—Vineet Kohli; Thomas R. Morrison

[57] ABSTRACT

A PTC device has two electrodes affixed to opposed surfaces. The electrodes consist of a metal foil having a conductive layer on their surfaces that contact the PTC material. The conductive layer has a thermal coefficient of expansion intermediate between the thermal coefficients of expansion of the metal foil and the PTC material. The intermediate value of the thermal coefficient of expansion of the conductive layer prevents peeling of the electrodes off the PTC element due to the variation of the temperature of the PTC device resulting from repeated voltage applications. In addition, improved adhesion of the electrodes to the PTC material reduces resistance changes after repeated temperature cycling.

13 Claims, 3 Drawing Sheets

PTC DEVICE

BACKGROUND OF THE INVENTION

The present invention relates to a PTC device and more particularly to an electrode composition.

Conventional PTC devices comprise a PTC element, formed of a PTC composition, which is interposed between two electrodes. An electrode is attached to each electrode. An enclosure totally covers the device. The electrodes are made of metal sheet or metal foil, and each electrode is affixed, using a heat press, to opposing surfaces of the PTC element. When a metal foil is used for the electrode, the surface of the electrode contacting the PTC element is generally smooth. In some cases, the surface is roughened surface as disclosed in Japanese Patent Laid-Open No. 196901/1985 and No. 98601/1987.

Another conventional PTC device comprises a PTC element having two electrodes embedded therein. Each electrode is a combination of the electrode itself and a lead terminal.

The temperature of a conventional PTC device is approximately room temperature in the absence of voltage impressed across the electrodes. However, if a voltage is impressed and increased up to and over a trip voltage, which is the voltage at which the PTC behavior the PTC element is exhibited, the resistance of the PTC device increases. The current flow through the PTC device thus decreases and the power dissipation in the PTC device reaches an equilibrium so the temperature of the device stays at a temperature at or around the trip temperature of the device. Accordingly, the temperature of the PTC device varies from room temperature to the trip temperature of the PTC device with each application of a trip voltage. Therefore, the PTC element and electrodes repeatedly expand and contract during temperature cycles resulting from ON/OFF voltage application cycles.

In general, the coefficient of thermal expansion of a PTC element at a temperature below the trip temperature of the PTC element is larger than that of the electrode. Therefore, when the PTC element expands with voltage applied across the electrodes, the expansion of the electrodes does not track the expansion of the PTC element. This results in the electrodes peeling off the PTC element. The degree of the peeling depends on the difference between the coefficient of thermal expansion of the PTC element and that of the electrode.

In order to overcome this problem of electrodes peeling off a PTC element, Japanese Patent Laid Open No. 196901/1985 and No. 98601/1987 disclose an electrode having a rough surface affixed to a PTC element. Even with roughened contacting surfaces, if the difference between the coefficient of thermal expansion of the PTC element and that of the electrode, at a temperature under the trip temperature of the PTC element, is sufficiently large, peeling of the electrode off the PTC element may still occur.

Another problem is that, as a the peeling process proceeds, the area of ohmic contact between the electrode and the PTC element decreases. Consequently, the electrode-to-electrode resistance of the PTC device tends to increase in proportion to the degree of the peeling.

OBJECTS AND SUMMARY OF THE INVENTION

Accordingly, it is an object of the present invention to provide a PTC device with high electrical stability that overcomes the drawbacks of the prior art.

It is a further object of the present invention to provide a PTC device with increased adhesion between a PTC element and an electrode.

It is a still further object of the present invention to provide a PTC device that uses an electrode of hybrid composition to prevent peeling of the electrodes off the PTC element due to thermal expansion of the PTC device resulting from repeated voltage applications.

Briefly stated, the present invention provides a PTC device, with high electrical stability, which comprises a PTC element formed of a PTC composition having conductive particles dispersed therein, and two electrodes formed of a metal foil having a conductive layer thereon, the conductive layer being formed of conductive paste made by blending a mixture of metal powder and binder. Each electrode is affixed to the PTC element in such a way that the conductive layer contacts the surface of the PTC element so that the metal foil itself is not in contact with the PTC element. The coefficient of thermal expansion of the conductive layer, during the time the PTC element is heating up its trip temperature, is an intermediate value between the coefficient of thermal expansion of the PTC element and that of the metal foil.

According to an embodiment of the invention, the present invention provides a PTC device comprising: a PTC element formed of a PTC composition and two electrodes formed of an electrode composition, the PTC composition being a polymer having conductive particles dispersed therein, the electrode composition being a metal foil having a conductive layer formed of a conductive coating of a conductive paste coated thereon, and each electrode being affixed by a heat press to opposing sides of the PTC element. The conductive layer has a coefficient of thermal expansion that is an intermediate value between the coefficient of thermal expansion of the PTC element and that of the metal foil, at temperatures up to the trip temperature of the PTC element.

According to a feature of the invention, there is provided a PTC device comprising a PTC element formed of a PTC composition and two electrodes formed of an electrode composition. The PTC composition is composed of a polymer having conductive particles dispersed therein and the electrode composition includes a metal foil having a conductive layer formed of conductive paste thereon. The conductive layer is a mixture of conductive particles and a binder. The conductive particles mixed therein include at least one of the metallic particles of pure metal or alloy, metallic particles coated with a different metal thereon, carbonaceous particles or carbonaceous particles coated with the pure metal or alloy thereon. The binder is a mixture of thermosetting resins or thermoplastic resins having heat resistant characteristics. The surface of the conductive layer is rough and the conductive layer has a coefficient of thermal expansion that is an intermediate value between the coefficient of thermal expansion of the PTC element and that of the metal foil, at temperatures up to the trip temperature of the PTC element.

According to a still further feature of the invention, there is provided a method for forming a rough surface on a conductive layer by a treatment such as, sandblast, exposure to plasma, irradiation by ultraviolet ray, or embedding metal powder.

The above, and other objects, feature and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
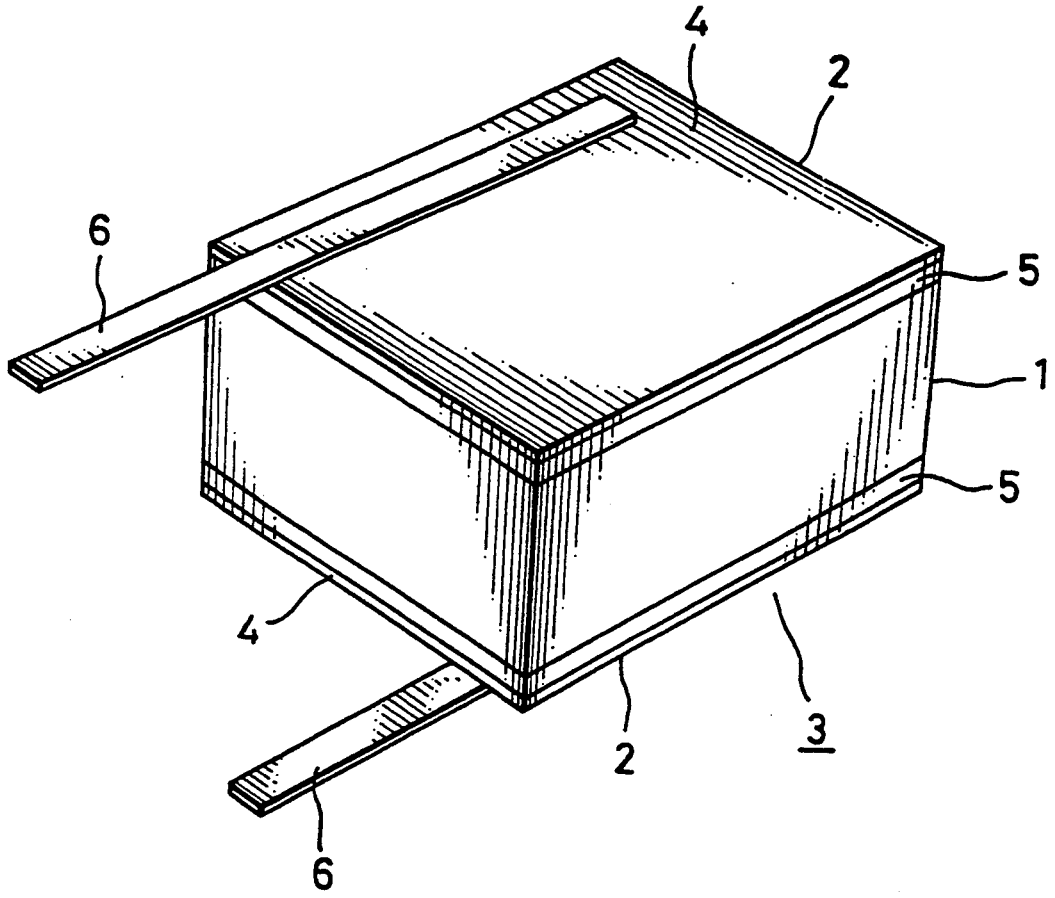
FIG. 1 is a perspective view of a PTC device according to an embodiment of the present invention.

Referring to FIG. 1, a PTC device 3 is a rectangular parallelepiped comprising a PTC element 1 interposed between two electrodes 2.

PTC device 3 comprises electrodes 2, compression molded onto the surface of a preformed PTC element 1 formed from a PTC composition having conductive particles dispersed therein. The electrode is comprised of a metal foil 4 having a conductive layer 5 thereon. The conductive layer 5 is formed from a conductive paste. Prior to bonding the electrode 2 to the PTC element 1, the surface of the conductive layer 5 is formed as one of a rough and a flat plane. The conductive paste is produced by blending a mixture of conductive particles and binder. The conductive particles may be contain at least one of a group of pure metals such as, Pt, Au, Ag, Ni etc., or a group of alloys consisting of Au-Pd, Ag-Pd etc., or those aforesaid metals and alloys plated with another metal, or carbonaceous particles such as, carbon black or graphite, or carbonaceous particles coated with a pure metal or an alloy. The binder is produced by blending a mixture of thermosetting resins such as epoxy resin or thermoplastic resins of types capable of withstanding operational temperatures of the PTC device.

In a first embodiment, a PTC element 1 was produced by blending a mixture of a PTC composition and conductive particles for 30 minutes using two mixing rolls while keeping the mixture at 135 C, followed by cooling and grinding into small pieces about 2 mm in diameter. The PTC composition comprises high density polyethylene (manufactured by Mitsui Petrochemical Industries, Hi-Zex 1300J) and ethylene-acrylic acid copolymer (manufactured by Dow Chemical Japan Ltd., Primacor 3330) wherein 50 g. of each are used. The conductive particles are comprised of carbon black (manufactured by Columbian Carbon Japan Ltd., Sevacarb MT) and 200 g. are used.

The electrodes 2 in the first embodiment are comprised of a metal foil 4 which has a rough surface and are made of electrolytic nickel (25 m in thickness, manufactured by Fukuda Metal Foil & Powder CO., Ltd.) and a conductive layer 5 coated on the metal foil 4. The conductive layer 5 is made of a conductive paste. The conductive paste is a mixture of 100 g. of an epoxy resin including a conductive silver paste (manufactured by Asahi Chemical Research Laboratory Ltd., LS-1003-1) and 3 g. of a hardener (manufactured by Asahi Chemical Research Laboratory Ltd., ACT-B). The mixture was painted on the surface of the metal foil 4 by screen printing and then subjected to heating and hardening for 60 minutes at 120° C. The electrodes 2 were then affixed onto the surface of the PTC element 1 by a heat press by applying a pressure of 400 kg/cm$^2$ for 8 minutes at 200° C., with the conductive layer 5 directly in contact with the PTC element. The PTC element 1 was then cross linked by gamma irradiation of 10 Mrad and formed into a mesh construction. The lead terminals 6 were spot welded to the surface of the electrodes 2. Through this process the PTC device 3 was finally assembled.

TABLE 2

| Sample of PTC device accord. to | Conductive layer | Surface of conductive layer | Resistance before test (Ω) | Resistance after test (Ω) | Variation ratio of resistance (%) |
|---|---|---|---|---|---|
| First embodiment | Yes | Rug | 0.248 | 0.263 | 6 |
| Second embodiment | Yes | Flat | 0.244 | 0.256 | 5 |
| First comparison example | No | Rug | 0.135 | 0.174 | 29 |
| Second comparison example | No | Flat | Measurement was impossible | Measurement was impossible | Measurement was impossible |

In the second embodiment, a PTC device 3 was produced in the same manner as the first embodiment, using the electrodes 2 of the first embodiment but with a flat conductive layer 5 instead of a rough one. In Table 2, the variation ratio of resistance of the sample according to the first embodiment is only 6%, calculated from the initial resistance of 0.248 ohms and the final resistance of 0.263 ohms after 400 applications of voltage. In the case of sample according to the second embodiment, the final resistance is only 5% over the initial resistance.

In the case of the first comparison example, the final resistance of 0.174 ohms is 29% over the initial resistance of 0.135 Q. Moreover, in the case of the second comparison example, the electrodes 2 peeled easily off the PTC element 1 due to insufficient adhesion between the electrodes 2 and the PTC element and the test was forced to stop.

Figure 2:
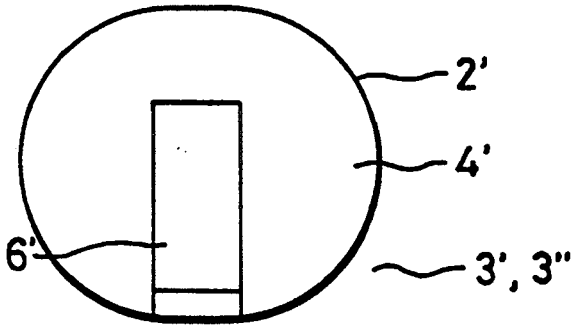
FIG. 2 is an front view of a PTC device according to other embodiments of the present invention.

Referring now to FIG. 2, test results illustrate that, in the case of a PTC device having an electrode 2′ made of metal foil 4′ with a conductive layer 5′ coated thereon, where the conductive layer 5′ is interposed between the PTC element 1′ and the metal foil 4′, the peeling of the electrodes 2′ off the PTC element 1′ can be prevented, where the peeling is due to the variation of temperature caused by repeated voltage applications. Accordingly, substantial increases in the resistance of the PTC device 3′ over its life are prevented.

In a third embodiment, a PTC element 1′ was produced by blending and grinding a mixture of a PTC composition and conductive particles using two mixing rolls for 20 minutes at 160 C, followed by cooling and grinding into small pieces about 2 mm in diameter.

The PTC element 1' was then cross linked by gamma irradiation of 10 Mrad and formed into a mesh construction. The lead terminals The measured values of the coefficient of thermal expansion of the PTC element 1, the metal foil 4, and the conductive layer 5 are shown in Table 1.

TABLE 1

| | Coefficient of thermal expansion (1/°C.) |
|---|---|
| Metal foil 4 | $1.3 \times 10^{-5}$/°C. |
| Conductive layer 5 | $1.0 \times 10^{-4}$/°C. |
| PTC element 1 | $5.9 \times 10^{-4}$/°C. |

As shown in Table 1, the coefficient of thermal expansion of the conductive layer 5 is $1.0\times10^{-4}$/°C. which is an intermediate value between $1.3\times10^{-5}$/°C. the metal foil 4 and $5.9\times10^{-4}$/°C. of the PTC element 1. Therefore, when the temperature of the PTC device 3 rises, the elongation of the conductive layer 5 is larger than that of the metal foil 4 but smaller than that of the PTC element 1. This intermediate value of thermal expansion of the conductive layer 5 prevents peeling of the electrodes 2 off the PTC element I.

In the first comparison example, a PTC device 3 was produced in the same manner as the first embodiment, using electrodes 2 without conductive layers.

In the second comparison example, a PTC device 3 was produced in the same manner as the second embodiment, using the electrodes of the second embodiment without conductive layer.

The test results of repeating voltage applications on the samples according to the above four types of PTC device are shown in Table 2. This test was made using the following process:

(a) The initial resistance was measured before the voltage application.

(b) A test voltage of 10 V DC was impressed across the electrodes 2 for 15 minutes, and then the voltage application was switched off for 15 minutes.

(c) The voltage application cycle was repeated 400 times.

(d) Finally, the resistance of each sampled was measured again, and then the variation ratio of resistance was calculated.

The PTC composition was comprised of 100 g. of high density polyethylene (manufactured by Mitsui Petrochemical Industries, Hi-Zex 3000B). The conductive particles were comprised of 200 g. of carbon black (manufactured by Cancarb Ltd., Thermax N990 Ultra Pure) which was previously heat-treated in a nitrogen atmosphere for 15 hours at 1000 C. Another component of the mixture was 2.5-dimethyl-2.5-di-tbutyl peraxy hexyne-3 (manufactured by Nippon Oil Fats Co., Ltd., Per-hexyne 25B-40) of 1.25 g.

Figure 3:
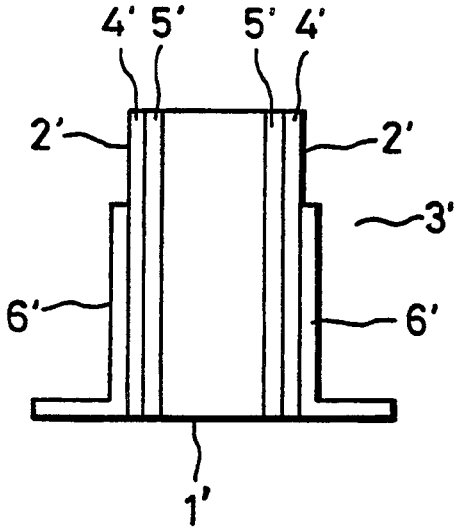
FIG. 3 is a side view of an embodiment in FIG. 2.

The electrode 2' in the third embodiment, illustrated in FIG. 2 and FIG. 3, is comprised of metal foil 4' with a rough surface and made of electrolytic nickel (25 m in thickness, manufactured by Fukuda Metal Foil & Powder Co., Ltd.) and conductive layer 5' coated on the metal foil 4'. The conductive layer 5' is made of a conductive paste which is a mixture including 100 g. epoxy resins and conductive silver paste (manufactured by Asahi Chemical Research Laboratory Ltd.), and 3 g of a hardener (manufactured by Asahi Chemical Research Laboratory Ltd., ACT-B). The mixture was painted on the surface of the metal foil 4' by screen printing and then subjected to heating and hardening for 60 minutes at 120 C. Then, the surface of the conductive layer 5' is roughened by sandblasting with an abrasive of Alundum #1000. After that, it is cut down to a rectangular form with 13 mm in each side. The electrode 2' is then affixed onto the surface of the PTC element 1' by heat pressing at a pressure of 400 kg/cm$^2$ for 8 minutes at 200 C, with the conductive layer 5' directly in contact With the PTC element. The PTC element 1' is cross linked by gamma irradiation of 10 Mrad, and then stamped out into an elliptical form with a size of $2.0\times1.7$ mm as shown in FIG. 2. The lead terminals 6' are spot welded to the surface of the electrodes 2'.

In the fourth embodiment, a PTC element 1 was produced in the same manner as the third embodiment.

Figure 4:
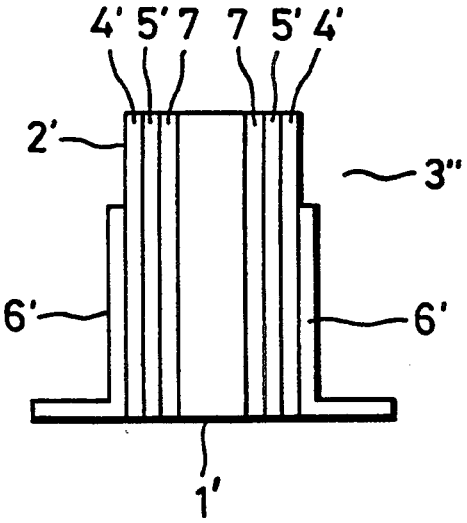
FIG. 4 is a side view of another embodiment in FIG. 2.

The electrode in the fourth embodiment of the PTC device 3", illustrated in FIG. 2 and FIG. 4, is comprised of metal foil 4' with a rough surface and made of electrolytic nickel (25 m in thickness, manufactured by Fukuda Metal Foil & Powder Co., Ltd.) and conductive layer 5' coated on the metal foil 4'. The conductive layer 5' is made of a conductive paste which includes a conductive silver paste and a phenol resin (manufactured by Asahi Chemical Research laboratory Ltd., LS-005P). The conductive paste 5' is painted on the surface of the metal foil 4' by screen printing. A powder of carbon nickel produced by carbonyl method (manufactured by Fukuda Metal Foil & Powder Co., Ltd., Type 287) is then embedded in the conductive paste. The metal foil 4' is then treated by heat hardening for 30 minutes at 150 C so that the conductive layer 5' has a rough layer 7 embedded with metallic powder therein giving the rough layer 7 a rough surface. The PTC device 3" shown in FIG. 4 is assembled in the same manner as the third embodiment.

In the third comparison example, a PTC device 3' was produced in the same manner as the third and fourth embodiment, using a metal foil 4' without conductive layer 5'.

Figure 5:
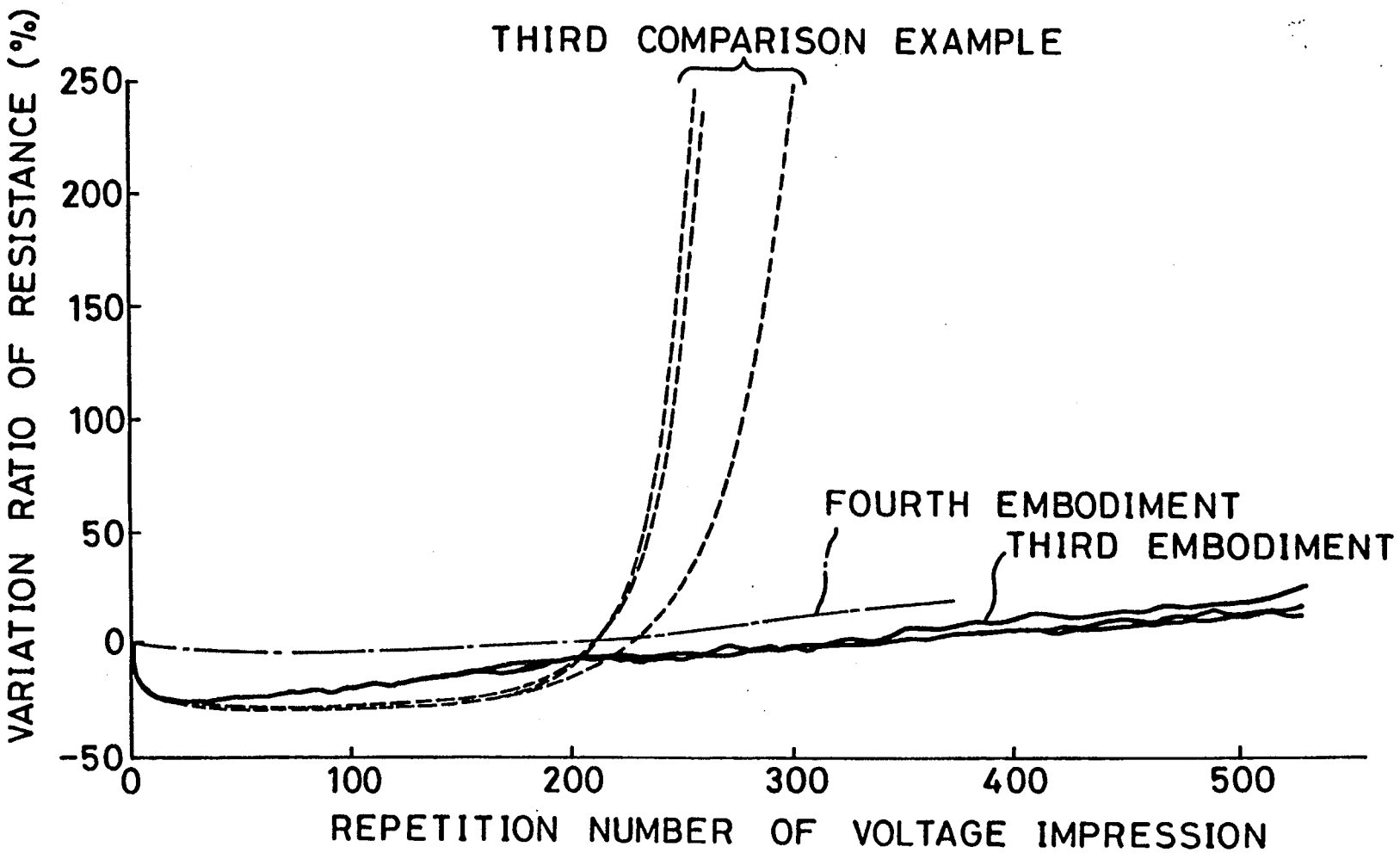
FIG. 5 is a curve showing relation between variation in resistance and the repetition number of voltage applications.

The test results of repeated voltage applications on the samples of the PTC devices 3', 3" according to the third and fourth embodiment and the third comparison example are shown in FIG. 5. This test was done using the following method:

(a) The initial resistance was measured before the voltage application.

(b) Test voltage of 32 V DC was impressed across electrodes 2 for 15 minutes and then the voltage application was switched off for 15 minutes.

(c) This cycle was repeated about 400 times.

(d) The resistance of each sample was measured at every OFF stage, and the variation ratio of resistance was calculated.

In FIG. 5, the increase in resistance of the samples in accordance with the third and fourth embodiment are very small. On the other hand, the increase in resistance of the sample in accordance with the third comparison example is so large that the resistance, after 300 voltage application cycles, increased to more than 200% of the initial value.

The test results in FIG. 2 illustrate that, in the case of PTC device having an electrode 2' made of metal foil 4' with conductive layer 5 coated thereon, where the conductive layer 5' is interposed between the PTC element 1' and the metal foil 4', the peeling of the electrodes 2' off the PTC element 1' can be prevented, where the peeling is due to the variation of temperature caused by repeated voltage applications. Accordingly, substantial increase of the resistance of the PTC device 3 may be prevented.

In the fourth embodiment, carbon nickel powder is used for a metal powder to embed in the conductive paste, however, silver powder may instead be embedded in the conductive paste in practicing this invention. Moreover, nickel powder produced by methods other than carbonyl method is also useful.

The rough surface of the conductive layer 5 to be affixed to the surface of the PTC element 1 can be formed by other methods such as, for example, plasma treatment and irradiation by ultraviolet rays instead of the sandblast method in the third embodiment or the embedding of metal powder practiced in the fourth embodiment.

According to the present invention, the electrodes 2', are comprised of metal foil 4' and conductive layer 5'. The conductive layer is formed by a coating of conductive paste upon the metal foil which is then affixed to the surface of the PTC element 1' by heat press, with the conductive layer 5' in direct contact with the surface of the PTC element 1'. The coefficient of thermal expansion of the conductive layer 5' during a period of heating up to the trip temperature of the PTC element 1' is an intermediate value between the coefficient of thermal expansion of the PTC element 1' and that of the metal foil 4'. Therefore, when the temperature of the PTC device 3' increases, the elongation of the conductive layer 5' will be less than that of the PTC element 1' but greater than that of the metal foil 4'.

Consequently, the conductive layer 5' between the electrode 2' and the PTC element 1' prevents peeling of the electrode 2' off the PTC element 1' under the variation of the temperature of the PTC device due to the repeated voltage applications. Furthermore, the resistance of the PTC device 3 is kept substantially uniform.

According to the present invention, the conductive paste is produced by blending a mixture of conductive particles and binder. The surface of the conductive layer 5', which is in contact with the PTC element 1', is rough so that the conductive layer 5' can prevent peeling of the electrode 2' off the PTC element 1' more effectively than the conductive layer 5 with a flat surface the PTC device is subjected to temperature variation due to the repeated voltage applications.

According to the present invention, the surface of the conductive layer 5 in contact with the PTC element 1 is roughened by the treatments including for example, sandblast, plasma, irradiation by ultraviolet rays, or embedding of metal powder. Therefore, the conductive layer 5 prevents peeling of the electrode 2 off the PTC element 1 very effectively when the PTC element is subjected to the variation of the temperature of the PTC device due to repeated voltage applications.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A PTC device comprising:

a PTC element formed of a PTC composition, including a polymer having conductive particles dispersed therein;

said polymer further includes at least one of a high density polyethylene and ethylene-acrylic acid copolymer;

two electrodes formed of an electrode composition;

said electrode composition including a metal foil having a conductive layer formed of a conductive paste;

said conductive paste further comprising a mixture of conductive particles and a binder coated thereon;

said conductive particles further comprising at least one conductive material selected from the group consisting of pure metal particles, metal alloy particles, metallic plated metal particles, carbonaceous particles, metallic coated carbonaceous particles, and metallic alloy coated carbonaceous particles;

wherein said pure metal particles include at least one selected from the group consisting of Pt, Au, Ag and NI and wherein said metal alloy particles include at least on of PD and Ag-Pd;

said binder being mixture of at least one of thermosetting resins and a thermoplastic resin having heat resistant properties capable of withstanding operational temperatures of said PTC device;

said two electrodes being affixed to opposed surfaces of said PTC element with said conductive paste contacting said opposed surfaces; and said conductive paste having a thermal coefficient of expansion intermediate between thermal coefficients of expansion of said PTC element and said metal foil.

2. The PTC device according to claim 1, wherein said PTC element is a parallelepiped.

3. The PTC device according to claim 1, wherein said conductive layer has a rough surface contacting said PTC element.

4. The PTC device according to claim 3, wherein a metal powder is embedded in said conductive layer so as to create said rough surface.

5. The PTC device according to claim 4 wherein the metal powder is at least one of nickel, carbonyl nickel, and silver.

6. A process for producing a PTC device which comprises:

forming a PTC element, formed of a PTC composition, including a polymer having conductive particles dispersed therein, having opposing sides;

said polymer further including at least one of a high density polyethylene, ethylene-acrylic acid copolymer, and conductive particles, wherein said conductive particles include at least one conductive material selected from the group consisting of pure metal particles, metal alloy particles, metallic plated metal particles, carbonaceous particles, metallic coated carbonaceous particles, and metallic alloy coated carbonaceous particles;

wherein said pure metal particles is at least one material selected from the group consisting of Pt, Au, Ag and Ni, and wherein said metal alloy particles are at least one selected from the group consisting of Au-Pd and Ag-Pd;

mixing a conductive paste further comprising a mixture of conductive particles and a binder;

said binder being mixture of at least one of thermosetting resins and a thermoplastic resin having heat resistant properties capable of withstanding operational temperatures of said PTC device;

coating first and second metal foils with said conductive paste;

curing said conductive paste to create a conductive layer on each of said first and second metal foils;

affixing said conductive layer on said first metal foil to a first surface of said PTC element; and affixing said conductive layer on said second metal foil to an opposed surface of said PTC element, whereby said PTC element is disposed between said first and second metal foils, with said conductive layers interposed between said PTC element and the respective metal foils.

7. A process according to claim 6 further comprising roughening surfaces of said conductive paste after curing thereof, and before the step of affixing.

8. A process according to claim 7 wherein the step of roughening includes exposing the conductive layer to a plasma.

9. A process according to claim 7 wherein the step of roughening includes exposing the conductive layer to an ultraviolet radiation.

10. A process according to claim 7 wherein the step of roughening includes embedding a metal powder into a surface of the conductive coating.

11. A process according to claim 10 wherein the metal powder is at least one of nickel, carbonyl nickel, and silver.

12. A process according to claim 6 wherein the step of forming the PTC element including a polymer having conductive particles dispersed therein further includes:

blending and grinding a mixture of a PTC composition and conductive particles at an elevated temperature;

cooling the mixture;

grinding the mixture into pieces;

forming the pieces into said PTC element; and exposing the PTC element to gamma radiation in order to cross link the resultant PTC element.

13. The process of claim 7, wherein the step of roughening including sandblasting the conductive layer.

* * * * *